US006609616B2

(12) United States Patent
Dilnik et al.

(10) Patent No.: US 6,609,616 B2
(45) Date of Patent: Aug. 26, 2003

(54) REFILLABLE TISSUE DISPENSER

(75) Inventors: Rebecca L. Dilnik, Neenah, WI (US); Dawn L. Houghton, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 41 days.

(21) Appl. No.: 09/753,072

(22) Filed: Jan. 2, 2001

(65) Prior Publication Data

US 2002/0084204 A1 Jul. 4, 2002

(51) Int. Cl.[7] ..... B65D 73/00
(52) U.S. Cl. ..... 206/494; 206/812
(58) Field of Search ..... 206/205, 210, 206/494, 812, 449; 221/34, 46, 49, 63, 155, 302, 309; 383/207, 209

(56) References Cited

U.S. PATENT DOCUMENTS

| | | | | | |
|---|---|---|---|---|---|
| 2,460,306 | A | | 2/1949 | Patterson | |
| 2,990,946 | A | | 7/1961 | Sheldon | |
| 3,174,644 | A | | 3/1965 | Kaltman et al. | |
| 3,239,097 | A | | 3/1966 | Bates et al. | |
| 3,306,492 | A | | 2/1967 | Kugler | |
| 3,414,185 | A | | 12/1968 | Young | |
| 3,446,395 | A | * | 5/1969 | Ballin | 221/63 |
| 3,570,752 | A | | 3/1971 | Sczesniak | |
| 3,632,017 | A | | 1/1972 | Matthews | |
| 3,679,094 | A | | 7/1972 | Nissen et al. | |
| 3,679,095 | A | | 7/1972 | Nissen et al. | |
| 3,817,514 | A | | 6/1974 | Nissen et al. | |
| 4,156,493 | A | | 5/1979 | Julius | |
| 4,185,754 | A | | 1/1980 | Julius | |
| 4,387,832 | A | | 6/1983 | Margulies | |
| 4,411,374 | A | | 10/1983 | Hotchkiss | |
| 4,420,080 | A | | 12/1983 | Nakamura | |
| 4,502,675 | A | | 3/1985 | Clark | |
| 4,538,396 | A | | 9/1985 | Nakamura | |
| 4,550,855 | A | | 11/1985 | Harrison | |
| 4,570,820 | A | | 2/1986 | Murphy | |
| 4,717,135 | A | | 1/1988 | Hathaway | |
| 4,979,613 | A | | 12/1990 | McLaughlin et al. | |
| 5,076,465 | A | | 12/1991 | Lawson | |
| 5,129,545 | A | * | 7/1992 | Parks | 221/63 |
| 5,143,249 | A | * | 9/1992 | Saint Criq et al. | 221/155 |
| 5,163,558 | A | * | 11/1992 | Palumbo et al. | 206/494 |
| 5,516,000 | A | | 5/1996 | Freiburger et al. | |
| 5,524,759 | A | | 6/1996 | Herzberg et al. | |
| 5,540,354 | A | * | 7/1996 | Annand | 206/449 |
| 6,296,143 | B1 | * | 10/2001 | Ghabriel | 221/63 |
| 6,349,849 | B1 | * | 2/2002 | Pehr | 221/63 |

* cited by examiner

*Primary Examiner*—Luan K. Bui
(74) *Attorney, Agent, or Firm*—Dority & Manning, P.A.

(57) ABSTRACT

A portable and refillable flexible tissue dispensing container is provided. The container includes several sides, and an opening for dispensing tissues in a ready mode for grasping by a user. The dispenser may be linked to a ring binder or a key chain for portable use, and pulling one tissue from the container orients the next successive tissue in place for dispensing. A dispensing opening may be provided with a releasable closure such as velcro (hook and loop), snaps, plastic, or the like. In a further more compact arrangement, the tissue may be bi-folded before being loaded into the dispenser.

22 Claims, 5 Drawing Sheets

REFILLABLE TISSUE DISPENSER

BACKGROUND OF THE INVENTION

Facial tissue is sold and dispensed from a variety of containers. In many instances, facial tissue is marketed and sold in disposable, rigid, cardboard containers for home use. Sometimes, decorative covers are used. Such covers are designed to fit upon (and over) a tissue box, to increase the decorative appeal and attractiveness of the box as it is provided on a flat surface for dispensing.

One drawback to current containment apparatus for tissues is that many of such containers do not lend themselves to easy and convenient transport. That is, large rectangular tissue boxes are inconvenient to carry in the course of daily activity. Smaller travel packs of tissue have been sold and used for mobile applications. Sometimes, but not always, such travel packs have included a smaller sized tissue sheet, with a decreased width and length of each tissue sheet as compared to tissues that are sold in full sized boxes.

Typically, such small travel packs comprise a stack of tissue that is housed within a plastic or polymer wrap. For example, some currently used travel packs marketed in Europe provide outer pack dimensions of about 8 inches (about 20 cm) in length and about 4 inches (about 10 cm) in width. Other travel packs are common in the United States which have dimensions of only about 4–5 inches (about 10 cm) in length and about 3 inches (about 7.5 cm) in width.

Many currently available travel packs are disposable, and therefore are not refillable. Travel packs typically include only one plastic opening (usually perforated) on one side of the plastic container. The single top side opening is often too small to enable the convenient insertion of additional tissues, as would be required to refill the pack. Additionally, tissue products containing lotion are not commonly packaged in portable packs due to incompatibility of the lotion with such plastic wrap coverings. Many currently available tissue travel packs are not designed for long term use, as the thin plastic outer covering of such packs is normally not capable of withstanding long term use and rough handling without breaking or tearing.

Consumer research reveals that people using travel packs would prefer to have a more substantial, more attractive, refillable tissue container. It has been determined that consumers are interested in using a more durable and attractive tissue container that is adapted to be carried on their person to school, work, and other places in connection with their daily activities. Many tissue users prefer to have tissues on their person at all times, wherever they go.

Students often do not have tissues available to them in a classroom setting, and therefore a travel pack designed to adapt to school use would be very desirable. Many students carry backpacks and book bags which are loaded with heavy books. Fragile items such as currently available travel packs may easily tear and break, resulting in the tissues becoming soiled or contaminated. Rigid boxed containers of tissue may become crushed and deformed if carried in backpacks or other items of personal luggage. Further, such rigid boxes are usually too large to be used in such a manner.

It is therefore be highly desirable to provide a durable tissue container that is not rigid, but is flexible, and which will not easily crush or become deformed. A container that is capable of being refilled by the user would be useful. Furthermore, a durable and attractive container that is small enough to fit easily into or upon a purse, glove compartment, backpack, book bag, briefcase, or other personal carry tote would be very desirable. A container that is capable of maintaining tissues clean and fresh while being carried with a person during his or her daily activities would be useful. Furthermore, a container that is easy to access and use when carried on or in a tote bag would be desirable.

SUMMARY OF THE INVENTION

A summary of the invention is provided below. The invention may take many forms, and the description provided herein is a rendition of several examples of the many diverse formats of the invention, and the invention is not limited to the specific structures described.

It is one object of the invention to provide a durable tissue container that is not rigid, and will not easily crush or become deformed. A further object of the invention is to provide a tissue container that is capable of being refilled by the user.

Another object of the invention is to provide a durable and attractive container that is small enough to fit easily into or upon a purse, glove compartment, pocket, backpack, book bag, briefcase, or other personal carry tote. A container which is capable of keeping tissues clean and fresh while being carried with a person during his or her daily activities is one application of the invention.

In one embodiment of the invention, it is an objective to provide a container as described, but with a pop-up tissue feature.

In still other embodiments of the invention, a container that is easy to access and use when carried on, attached to, or kept in a tote or backpack would be desirable.

In the invention, a flexible container having a first wall, a second wall, and a plurality of sides is provided. The first wall includes a dispensing opening for releasing tissues and a second wall having a loading opening through which new tissues are admitted into the container to replenish the supply of tissues in the container. The container also may include an attachment margin, the margin being located along one edge of the container wherein at least one hole is provided in a wall of the container along said margin, the hole being configured and sized for interaction with a clasping device.

The dispenser may also include, in another embodiment, a margin comprising at least three holes along its length. The dispenser may be adapted for interaction with a multi-ring binder. A flexible container may be constructed of a material selected from cloth, nylon, plastic and fabric.

The loading opening in the dispenser should be capable of opening and closing using an enclosure system. The enclosure system may include a fastening means such as a zipper, snaps, hook and loop type releasable fasteners, tape, buttons/holes, or resealable plastic. An enclosure system that is waterproof or water resistant also may be provided.

The dispenser, in one embodiment, provides tissues in a folded stack such that the tissues are operably connected to each other. This arrangement enables a first tissue to be pulled from the dispensing opening, and a second tissue immediately made available for grasping by emerging from the dispensing opening into a ready position. This is sometimes referred to as a "pop-up" configuration. The dispenser may provide the tissues in a bi-fold configuration, in which the stacked tissues are folded lengthwise at their midline, in other embodiments.

A dispenser may be provided containing about 20 to about 100 tissues when the container is fully loaded. However, other embodiments may employ less or more tissues, depending upon the geometry and size of the container.

In some embodiments, there is a clip attached to the container. The clip may be used to attach the container to any object, including but not limited to key chains, backpacks, purses, tote bags, briefcases, coats, clothing, carry-on bags, luggage, and the interior of automobiles.

In one aspect of the invention, a portable, refillable tissue dispenser is provided which comprises a tissue storage means, in which the tissue storage means includes a flexible material, the tissue storage means having a first and a second planar surface, the first planar surface comprising a dispensing opening adapted to release tissues, the second planar surface comprising a tissue loading opening through which new tissues may be admitted to the container to replenish the tissue supply in the container. Further, in other embodiments, the tissues are provided adjacent to one another while in a storage mode and then held erect and partially on the exterior of the tissue storage means while in a grasping mode. The tissues may be folded upon themselves so as to be capable of self-feeding, whereby the outermost tissue being held erect in the grasping mode is, when pulled from the container, capable of leading the next adjacent tissue into an erect grasping mode. In this way, each successive tissue is pulled from the container as the succeeding tissues are brought into the erect grasping mode and made available for the tissue user.

BRIEF DESCRIPTION OF THE DRAWINGS

A full and enabling disclosure of this invention, including the best mode shown to one of ordinary skill in the art, is set forth in this specification. The following Figures illustrate the invention.

DETAILED DESCRIPTION OF THE INVENTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention, which broader aspects are embodied in the exemplary constructions.

Figure 1:
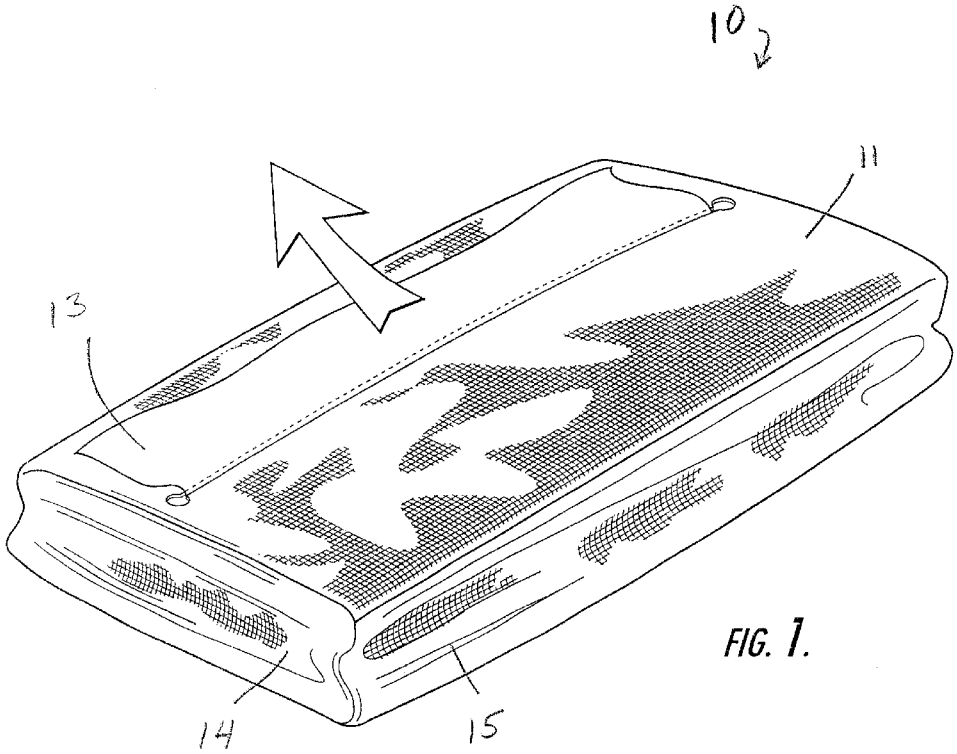
FIG. 1 is a perspective view of a flexible container of the invention.
Figure 2:
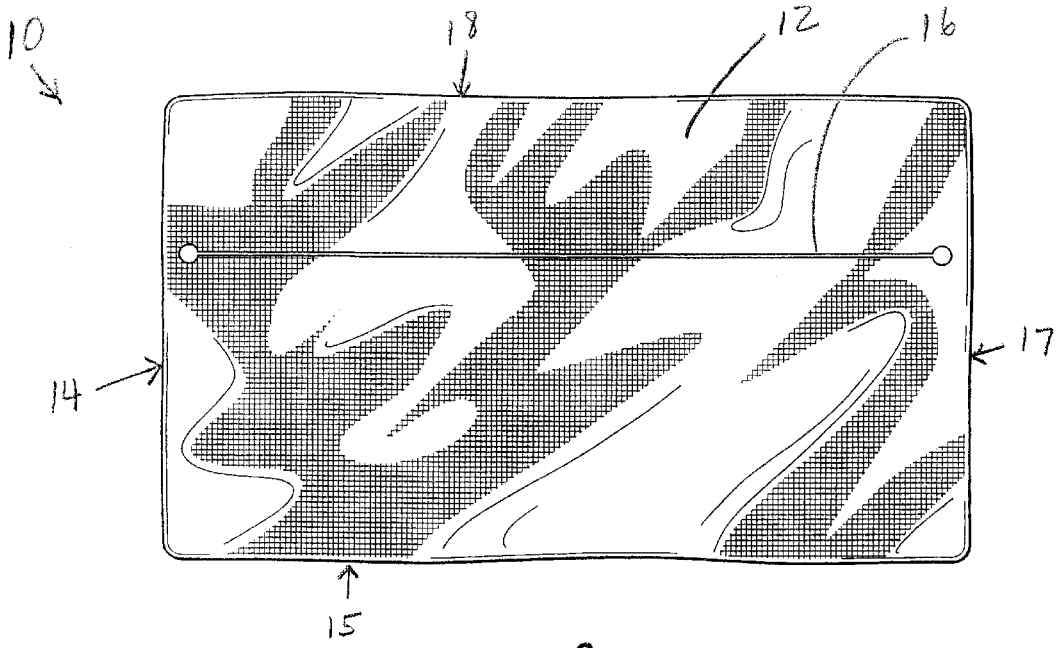
FIG. 2 shows the underside of the flexible container shown in FIG. 1.

Turning to FIG. 1, a flexible container 10 is provided having on its interior surface a plurality of tissues 13 stacked for dispensing. The container 10 comprises a first wall 11, which is essentially a planar surface of flexible material. A second wall 12 is on the underside of the container 10, shown more fully in FIG. 2. The second wall 12 is also a planar surface of flexible material in most cases, although it could be more rigid and stiff in some applications. The flexible container 10, shown in FIG. 1, comprises a plurality of sides, including first side 14, second side 15 and other sides not shown in FIG. 1. The underside of the flexible container 10 shown in FIG. 1 may be seen in FIG. 2. A releasable plastic loading opening 16 is shown extending from a point near the first side 14 along the length of the container 10 to a point near the third side 17. A fourth side 18 and a second side 15 are also seen in FIG. 2.

Figure 3:
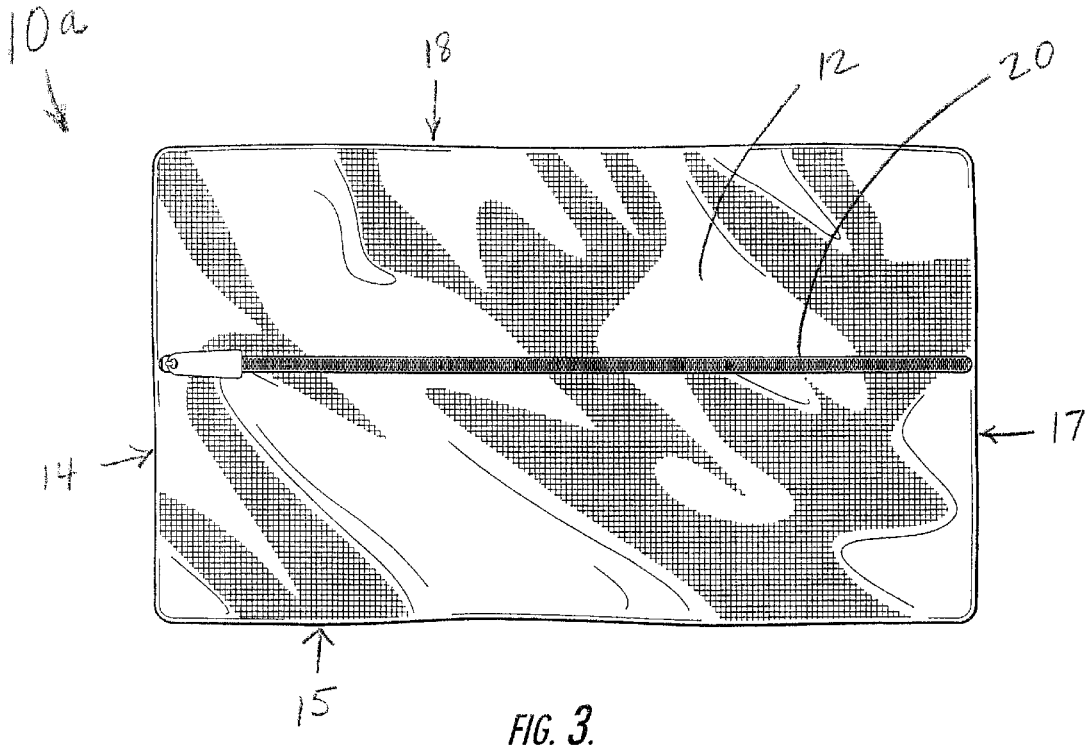
FIG. 3 shows an alternate configuration of the flexible container shown in FIGS. 1–2.
Figure 4:
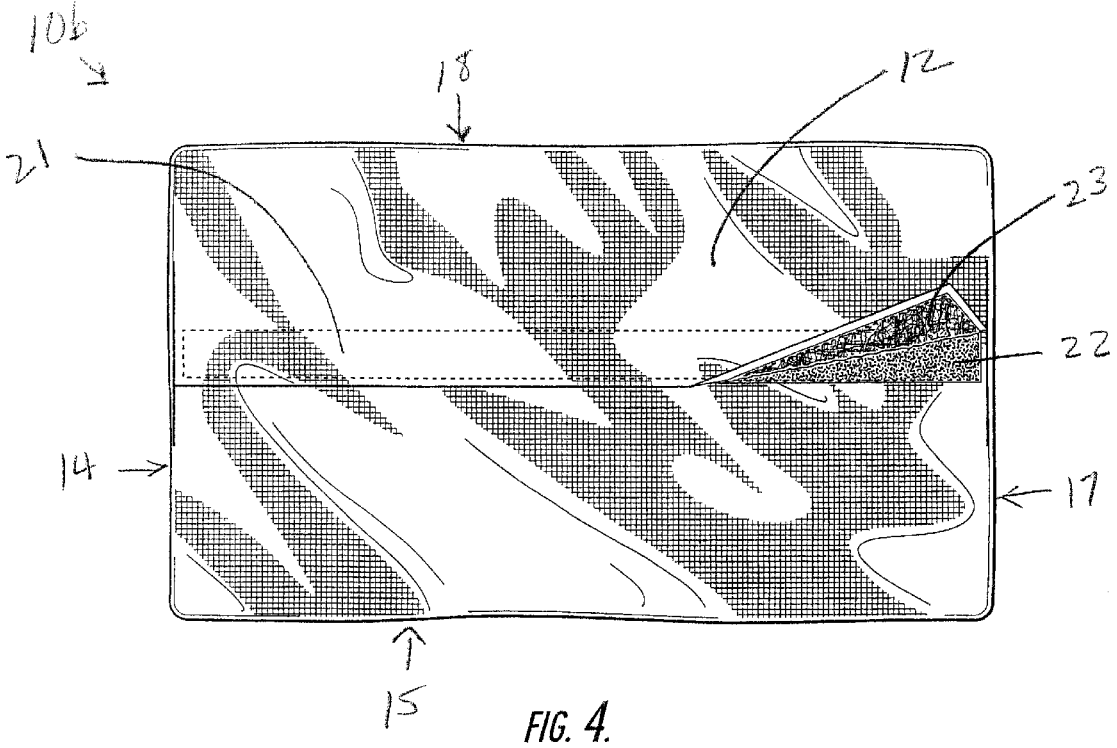
FIG. 4 shows yet another alternate configuration of the flexible container.

In FIG. 3, an alternative embodiment of the invention is shown which includes a zipper loading opening 20 through which tissues are loaded into the flexible container 10*a*. A further embodiment of the invention is seen in FIG. 4, which includes a hook and loop (or "Velcro®") loading opening through which tissues may be loaded into the dispenser. One important feature of the invention is that in most cases, the flexible container 10*b* of the invention may be reloaded with tissues in the form of a relatively permanent dispenser, as opposed to dispenser that are not easily reloaded, which are disposable and throw-a-way type dispensers. In FIG. 4, a back face 23 is seen turned upwards and released from the front face 22 that comprises hook material. The back face 23 contains loop material, that releasably engages the hook material of front face 22. This type of enclosure is often known as a "Velcro®" enclosure (Velcro® is believed to be a trademark of the 3M Company of Minneapolis, Minn.). In other embodiments of the present invention, the front face 22 could be loop material and the back face 23 could be hook material.

Figure 5:
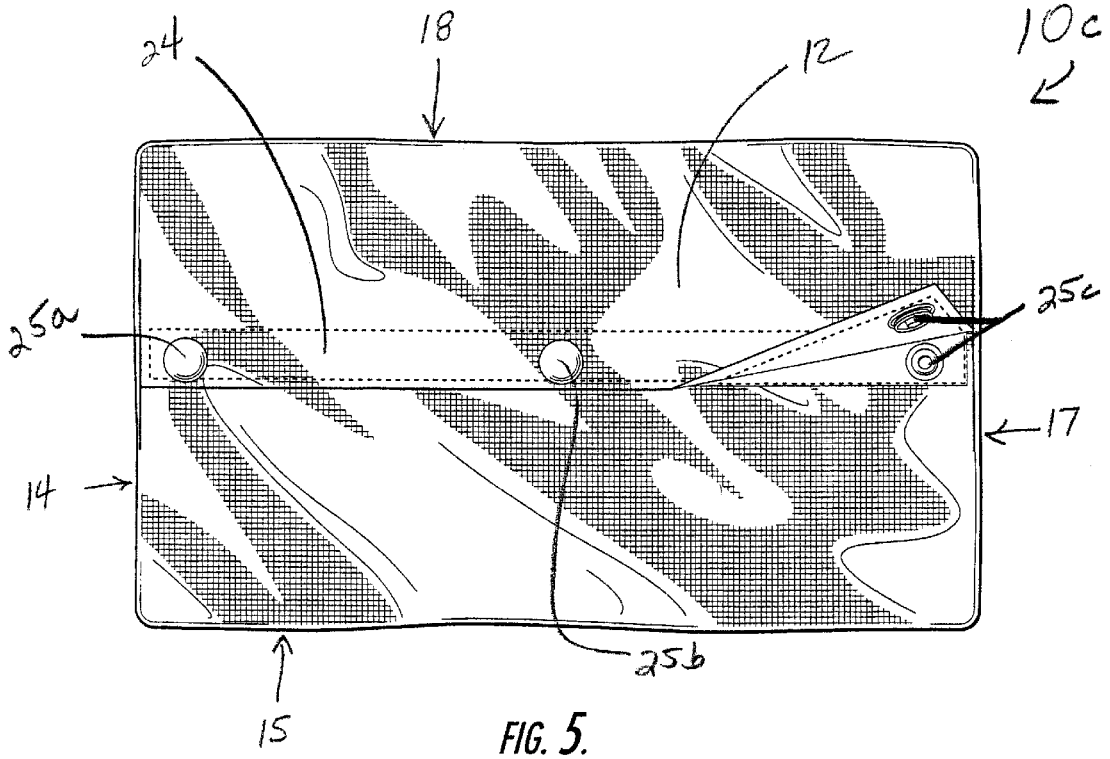
FIG. 5 shows yet another configuration of the flexible container.

FIG. 5 shows yet another embodiment of the invention in which the snapped loading opening 24 on the underside of the flexible container 10*c* is comprised of a margin along which one or more snaps releasably engage to facilitate the reloading of the flexible container 10 with new tissues. Snaps 25*a–c* are shown in FIG. 5.

Figure 6:
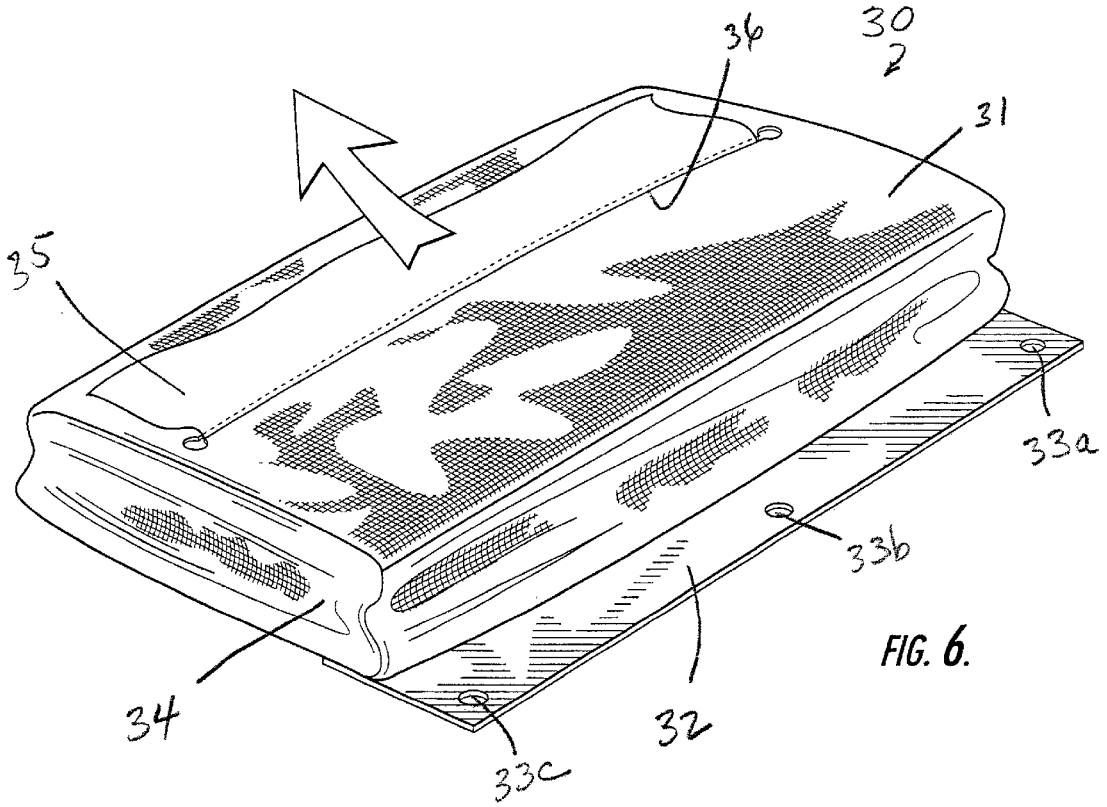
FIG. 6 is a perspective view of one embodiment of the invention in which the container is adapted for insertion into a ring binder or notebook.

FIG. 6 reveals a ring binder container 30 which comprises a first wall 31 that is a planar or relatively flat surface. A tissue 35 is popped up for dispensing from the dispensing opening 36 in the first wall 31. Furthermore, a first side 34 is seen on the edge of the ring binder container 30. Importantly, this particular embodiment comprises a margin 32 along which a plurality of holes 33*a–c* may be located for releasable engagement with a ring binder (not shown). The holes 33*a–c* are shown near the lower right portion of FIG. 6, and the ring binder container 30 may be placed into a notebook or ring binder for convenient and easy use. The second wall (not shown) contains a loading opening having a fastening means as disclosed herein.

Figure 7:
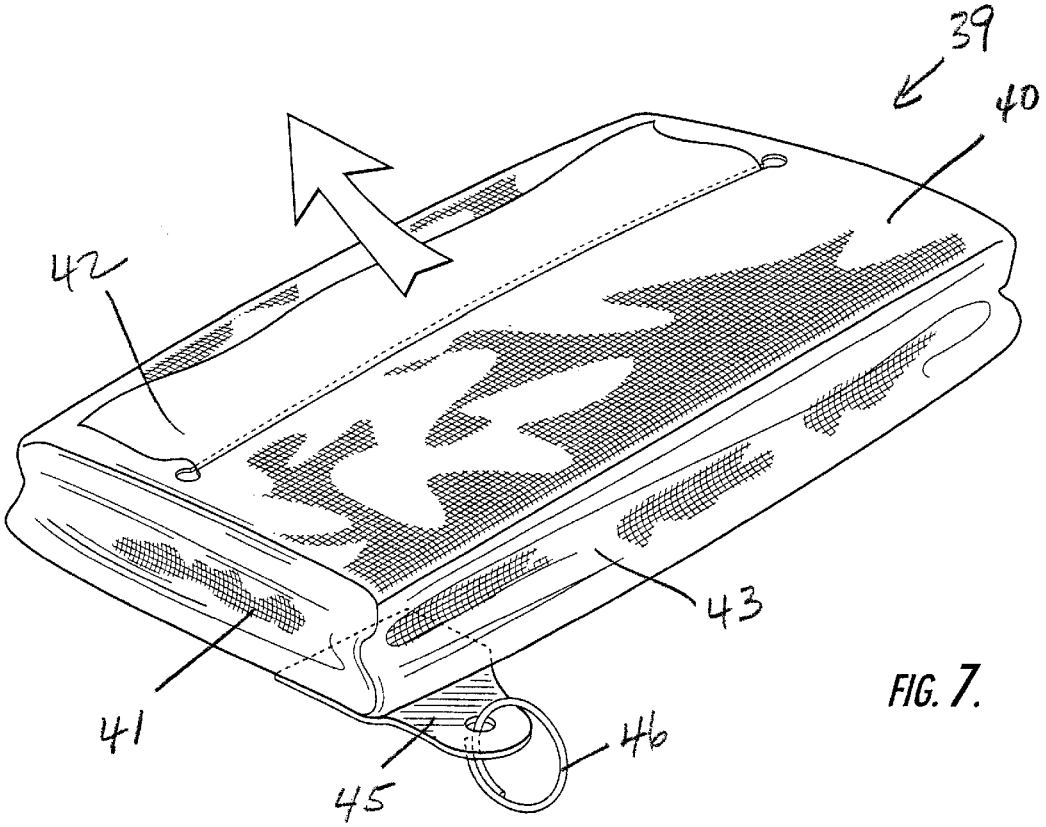
FIG. 7 shows an alternative configuration of the invention in which the flexible container is adapted for releasable attachment using a ring structure.

FIG. 7 shows yet another embodiment of the invention comprising a ring container 39 with a first wall 40 having a first side 41. The ring container 39 is capable of dispensing tissue 42. A second side 43 is seen on the right side of FIG. 7. Furthermore, the ring container 39 contains a link or attachment means 45 along its margin which may contain a ring 46 that is capable of securing the ring container 39 to essentially any object that makes it convenient for the user. The second wall (not shown) contains a loading opening having a fastening means as disclosed herein.

Figure 8:
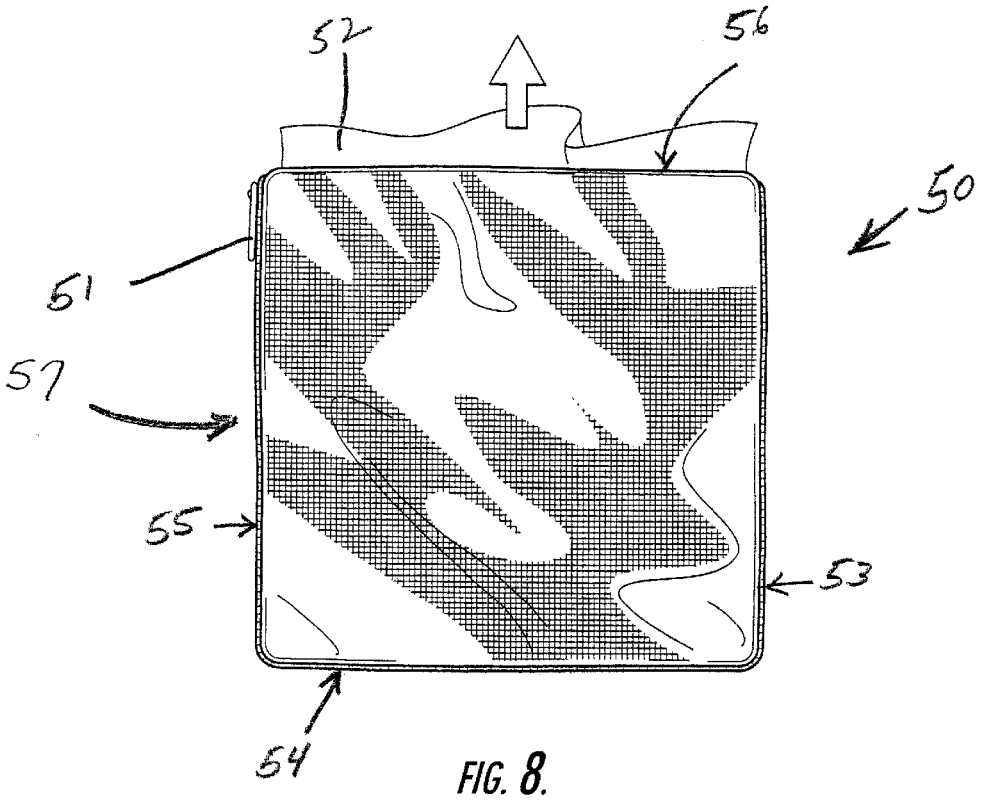
FIG. 8 is a bi-fold configuration of the invention.

FIG. 8 includes a bi-fold configuration container 50 which contains tissue 52 similar to that contained in the containers of FIGS. 1–7, except that the tissues 52 are folded lengthwise prior to being placed into the bi-fold container 50. A dispensing opening 56 along one edge of the bi-fold container 50 provides an opening through which the tissue 52 may be pulled from the bi-fold container 50. Furthermore, a first side 53, second side 54 and third side 55 is shown. A zipper pull tab 51 is shown in the closed position of the loading opening 57. In order to reload the container 50, one may simply pull the zipper pull tab 51 downward along one, two, or three sides of the container 50, as necessary, to reload tissues 52 for dispensing. An alternate configuration within the scope of the invention could include a container that is longer, in which the tissues are bi-folded along the long axis of the tissue. It also would be possible to provide a pocket holster, or pocket protector configuration, that holds tissues ready to dispense from a pocket, such as a shirt pocket.

Figure 9:
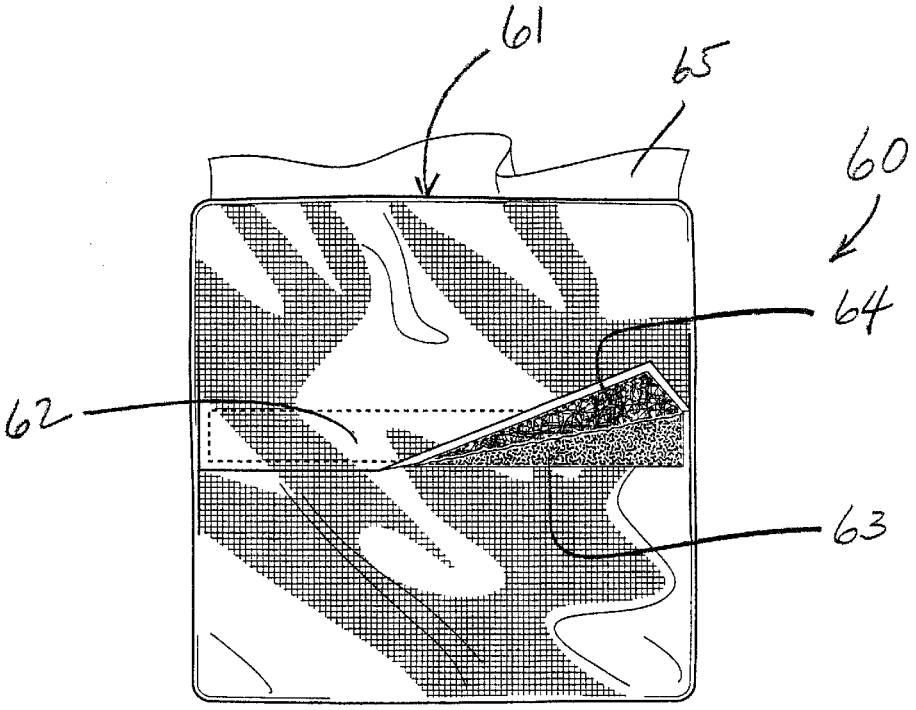
FIG. 9 is yet another bi-fold configuration of the invention.

FIG. 9 depicts another bi-fold configuration that comprises bi-fold container 60. In this particular embodiment, a dispensing opening 61 releases tissues 65. A loading opening 62 comprises a hook fastener face 63 and a loop material face 64 which are capable of releasably engaging to provide an opening 62 through which tissues 65 may be loaded into the container 60.

Figure 10:
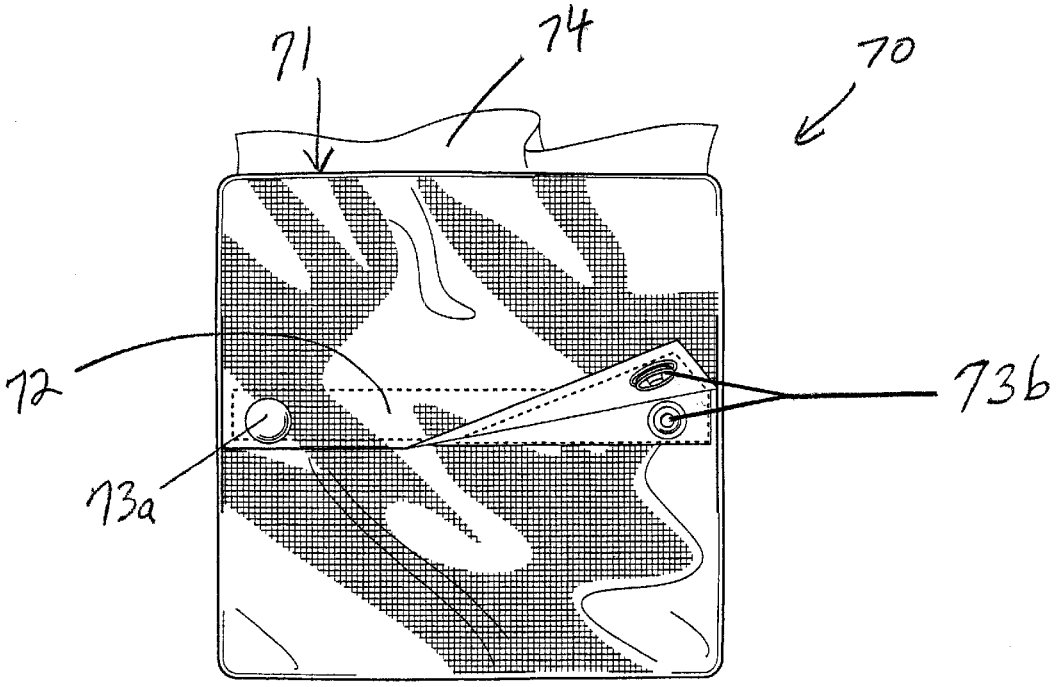
FIG. 10 shows another bi-fold configuration of the invention.

In FIG. 10, still another embodiment of the bi-fold container 70 is shown in which a dispensing opening 71 dispenses tissues 74. The tissue 74 may be loaded into the bi-fold container 70 by way of loading opening 72 that comprises releasable snaps 73*a* and snap 73*b*. An alternate configuration of the container 70 shown in FIG. 10 could include a necklace (hung around the neck), bracelet (hung around the wrist), or wrist band package (held in place as an athletic wrist band).

In any of the applications of the invention described above, the container may be comprised of any flexible material that is attractive and durable, including leather, nonwovens, plastic, cloth, nylon, polymeric materials, man made materials, natural materials, synthetic materials, or other materials. Furthermore, the fastening means and releasable enclosures used in the invention may comprise zippers, snaps, hook and loop fasteners, resealable plastic fasteners, or essentially any other fastening system that makes it easy and convenient for a user to open the container, place tissues inside the container, and reseal the container for use.

Furthermore, many of the containers shown in the above Figures and used in the practice of the invention have a capacity of about 20 to about 100 tissues, and most preferably about 20 to 50 tissues.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A tissue dispensing device, comprising:

a flexible container having a first wall, a second wall, and a plurality of sides, the first wall having a dispensing opening for releasing tissues, the second wall having a loading opening through which new tissues are admitted into the container to replenish the supply of tissues in the container, the flexible container further comprising an enclosure system for closing the loading opening after new tissues are admitted into the container, the enclosure system comprising a closure device.

2. The tissue dispensing device of claim 1 further comprising:

an attachment margin, the margin being located along one edge of the container wherein at least one hole is provided upon said margin, the hole being configured and sized for interaction with a clasping device.

3. The tissue dispensing device of claim 2 wherein the margin comprises at least two holes.

4. The device of claim 2 wherein the margin is adapted for interaction with a ring binder.

5. The device of claim 1 in which the flexible container is constructed of a material selected from the group consisting of leather, nonwovens, cloth, nylon, plastic wrap, and fabric.

6. The device of claim 1 in which the closure device comprises a device selected from the group consisting of:

(a) zipper, (b) snaps, (c) hook and loop fasteners, (d) resealable plastic, (e) releasable plastic, and (f) combinations thereof.

7. The device of claim 1 in which tissues are provided in a folded stack within the container, the tissues being operably connected to each other such that once a first tissue is pulled from the dispensing opening, a second adjacent tissue is immediately made available for grasping by emerging from the dispensing opening into a ready position.

8. The device of claim 6 in which the tissues are held in the dispenser in a bi-fold configuration.

9. The device of claim 1 in which the dispenser contains about 20 to about 100 tissues when the container is fully loaded.

10. The device of claim 2 in which the container additionally comprises a clip attached to the container.

11. A portable, refillable tissue dispensing device comprising:

(a) tissue storage means, said tissue storage means being comprised of a flexible material, the tissue storage means having a first and a second planar surface, the first planar surface comprising a dispensing opening adapted to release tissues, the second planar surface comprising a tissue loading opening through which new tissues may be admitted to the container to replenish the tissue supply in the container, the tissue dispensing device further comprising a closure device for closing the loading opening when new tissues are not being admitted to the container; and (b) tissues, the tissues being adjacent to one another while in a storage mode and held erect and partially on the exterior of the tissue storage means while in a grasping mode, the tissues being folded upon themselves so as to be capable of self-feeding where a first tissue is pulled whereby the outermost tissue being held erect in the grasping mode is, when pulled from the container, capable of leading the next adjacent tissue into an erect grasping mode, such that as each successive tissue is pulled from the container the succeeding tissues are brought into the erect grasping mode and made available for the tissue user.

12. The refillable tissue dispensing device of claim 11, further comprising an attachment means for releasably connecting said dispenser to another object.

13. The tissue dispensing device of claim 11 wherein the tissues reside in the dispenser in a bi-fold configuration.

14. The device of claim 11 in which the first planar surface of the storage means comprises a predetermined and permanent attachment to the second planar surface of the storage means.

15. The device of claim 12 wherein the attachment means comprises a link along a margin of said first or second planar surface.

16. The device of claim 15 in which the link along said margin is comprised of a ring clasp secured to holes in the first planar surface, the holes being located at a plurality of sites along the margin.

17. The tissue device of claim 16 in which the link along the margin secures the tissue dispenser to a three ring binder.

18. The device of claim 12 in which the attachment means comprises a clip.

19. The device of claim 11 in which the closure device is selected from the group consisting of zippers, releasable plastic, resealable plastic, snap closures, and hook-and-loop fasteners.

20. The device of claim 19 in which the closure device comprises a zipper.

21. The device of claim 20 in which the zipper closure is provided along at least two sides of the first planar surface.

22. The device of claim 20 in which the closure device is provided along at least three sides of the first planar surface.

* * * * *